United States Patent [19]

Schopieray

[11] Patent Number: 4,465,085

[45] Date of Patent: Aug. 14, 1984

[54] PERMANENT WAVE ROD

[75] Inventor: James L. Schopieray, 4197 Brammer Dr., Traverse City, Mich. 49684

[73] Assignees: James L. Schopieray; Thomas E. Smith, both of Rapid City, Mich.

[21] Appl. No.: 14,244

[22] Filed: Feb. 22, 1979

[51] Int. Cl.[3] ..... A45D 2/14

[52] U.S. Cl. ..... 132/42 A

[58] Field of Search ..... 132/42 A, 42 R, 40, 132/41

[56] References Cited

U.S. PATENT DOCUMENTS

| | | | |
|---|---|---|---|
| 2,396,782 | 3/1946 | Grant | 132/42 R |
| 2,720,882 | 10/1955 | Solomon | 132/40 |
| 2,793,645 | 5/1957 | Grant | 132/42 R |
| 2,809,643 | 10/1957 | Schoendorf | 132/42 R |
| 2,938,523 | 5/1960 | Solomon | 132/42 R |
| 4,056,109 | 11/1977 | Takai | 132/40 |

*Primary Examiner*—Gregory E. McNeill

*Attorney, Agent, or Firm*—James M. Deimen

[57] ABSTRACT

The permanent wave rod disclosed in this application comprises a hard plastic core surrounded by a soft pliable non-absorbent rubber sleeve. The rubber sleeve includes a plurality of longitudinal shallow grooves to more evenly distribute the permanent wave solutions to the inside of the hair curl wound about the rod. The diameter of the rod decreases from the ends of the rod toward the center to better fit the head and more evenly distribute the tension on the hair as it is wrapped about the rod. The soft pliable rubber provides an even tension to the wrapped hair.

A rubber strap extends from one end of the rod and is stretched over the wrapped hair to a fastening socket at the other end thereby holding the curl of hair in place on the rod. The end of the rod from which the strap extends includes four radial grooves. The strap is placed in one of the radial grooves to assure that the strap returns to the original position on the hair after having been pulled away. The strap includes a tab extending from about the center of the strap that enables the hairdresser to grasp the strap and pull it away from the curl of hair during treatment without disturbing the hair.

7 Claims, 5 Drawing Figures

PERMANENT WAVE ROD

BACKGROUND OF THE INVENTION

The invention pertains to the field of hairdressing and in particular to curling rods for cold permanent waving of hair. Over the years a number of curling rods or permanent wave rods have been developed. The curling rods disclosed in U.S. Pat. Nos. 2,242,850, 2,386,612 and 2,652,840 are directed to the curling of hair as it drys but do not provide means for adequately distributing permanent wave solution to the interior of the curl. U.S. Pat. Nos. 2,825,344 and 2,896,638 disclose rods with interior radial passages to distribute the permanent wave solution. The hard plastic construction of such rods tends to break fine hair especially when the surface is roughened as in U.S. Pat. No. 2,825,344. U.S. Pat. Nos. 2,747,585 and 3,056,413 disclose rods with disposable elements that are broken to release permanent wave solution to the interior of the rod and hair curl. Such rods are not reusable.

Disclosed in U.S. Pat. No. 2,757,676 is a rod of spongy absorbent material to reduce hair breakage and absorb excess permanent wave solution. The spongy material is difficult to clean for reuse and traces of solution from previous use can burn the hair, cause hair breakage and permanently damage the hair until the growth of replacement hair.

The hard plastic grooved rod disclosed in U.S. Pat. No. 2,395,965 or at the other extreme the multiple flexible strands disclosed in U.S. Pat. No. 2,721,560 both tend to produce hair breakage when the tensioned hair curl on the rod is softened by the permanent wave solution. Despite the extensive devlopment of permanent wave rods, difficulties in their use and safety remain.

SUMMARY OF THE INVENTION

The permanent wave rod disclosed below comprises a hard plastic core surrounded by a soft pliable non-absorbent rubber sleeve. The rubber sleeve includes a plurality of shallow longitudinal grooves to more evenly distribute the permanent wave solution to the inside of the hair curl wrapped thereabout. The pliable characteristic of the rubber sleeve reduces the stress on the hair adjacent the grooves. Preferably about fifteen shallow grooves are provided to evenly distribute the permanent wave solution and enable the solution to be thoroughly rinsed out of the curl subsequently. The diameter of the rod decreases from the ends of the rod toward the center to better fit the head and to more evenly distribute the tension on the bulk of the hair tress. The shape in combination with the soft pliable non-absorbent multiple grooved rubber sleeve provides an even tension to the wrapped hair, allows the penetration of permanent wave solution and rinse to the interior of the curl and permits the rod to be easily washed and reused without hazard. A rubber strap extends from one end of the rod and is stretched over the wrapped hair to a fastening socket at the other end thereby holding the curl of hair in place on the rod. The end of the rod from which the strap extends includes four radial grooves. The strap is placed in one of the radial grooves to assure that the strap returns to the original position on the curl of hair after having been pulled away. The strap includes a tab extending from the center of the strap that enables the hairdresser to grasp the strap and pull it away from the curl of hair without disturbing the hair. The strap is preferably relatively wide to lessen the stress on the hair. The tab enables the hairdresser to grasp and raise the strap as solution is added or the curl is rinsed thereby assuring that the hair under the strap is properly treated.

DESCRIPTION OF THE PREFERRED EMBODIMENT

Figure 1:
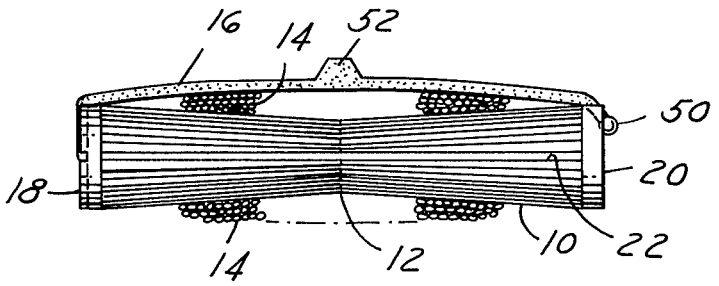
FIG. 1 is a side view of the rod.

As shown in FIG. 1 the permanent wave rod comprises a central portion 10 generally circular in cross-section and symmetric with respect to the center section of least diameter at 12. The hair tresses 14 are wrapped about the rod to form the hair curl. A flexible rubber strap 16 extends from the left hand end cap 18 to the right hand end cap 20 thereby retaining the hair tress 14 in place. The central portion 10 includes multiple longitudinal shallow grooves 22. Fifteen grooves are satisfactory, although there can be somewhat more or less.

Figure 2:
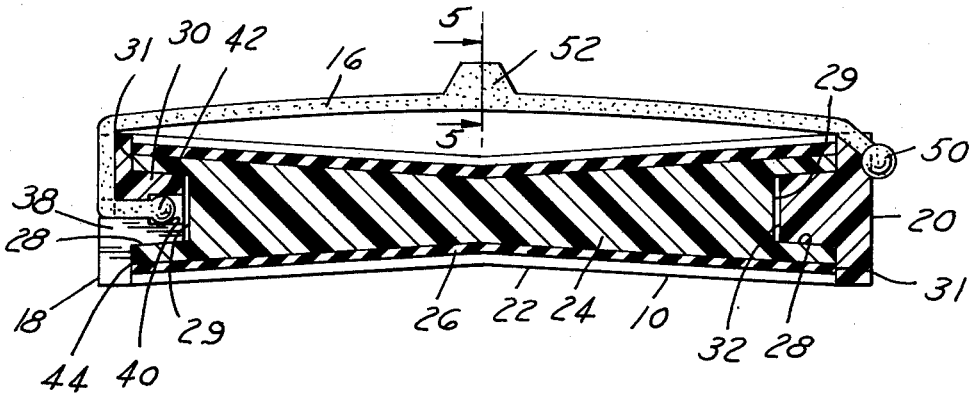
FIG. 2 is a side cross-section of the rod.

In FIG. 2 a cross-section of the central portion 10 and end caps 18 and 20 are shown. The central portion 10 consists of a central core 24 formed of a hard plastic material surrounded tightly by a soft pliable rubber sleeve 26 in the surface of which the multiple shallow grooves 22 are formed. The hard plastic core provides strength and rigidity to the rod and the soft pliable rubber sleeve gently forces the curl of hair outward after the strap 16 is fastened over the curl. The amount of tension developed in the curl is determined by the hairdresser when the first wrap of hair is made about the rod. The multiple shallow grooves 22 perform two functions. The grooves assist in rolling the hair upon the rod by lightly grabbing the first wrap and subsequently by assuring that permanent wave solution and rinse thoroughly penetrate to the underside of the hair curl. The grooved pliable surface permits the hair to be rolled on without slippage and without damage to the hair because the hair sinks slightly into the rubber instead of breaking on the hard plastic grooved or roughened surface of the prior art rods. The grooved sleeve 26 is formed of a non-absorbent rubber to prevent the penetration of permanent wave solution into the rubber. Thus, the rod can be washed and rinsed with assurance that no solution from previous use remains on the rod.

Figure 3:
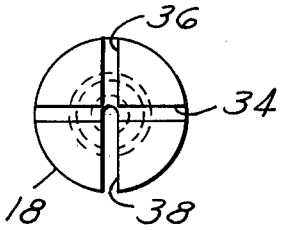
FIG. 3 is an end view of the left hand end cap of the rod.
Figure 4:
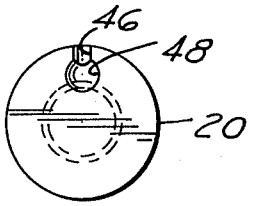
FIG. 4 is an end view of the right hand end cap of the rod.

At each end of the central core 24 a conical socket 28 is formed to receive either complementary male portion 30 of left hand cap 18 or complementary male portion 32 of right hand cap 20. The male portions 30 and 32 are sized to provide an interference fit with the sockets 28. Alternatively, a snap fit or threaded engagement could be provided to fasten the caps 18 and 20 to the central portion 10. Clearance 29 is provided at the base of the socket 28 to assure that the caps 18 and 20 will fit snugly against the ends 31 of the central portion 10. In cap 18 radial cross slots 34 and 36 are formed as shown in FIG. 3. The slots 34 and 36 are shallow and sized to accept the strap 16 as shown best in FIG. 2.

A portion 38 of the slot 36 extends through the cap 18 including the male portion 30. Formed in the male portion 30 is a small socket 40 having a diameter slightly larger than the width of the slot 36. The strap 16 has an enlarged knob 42 adapted to fit in the socket 40 as shown. The portion 38 of the slot 36 permits the strap 16 and knob 42 to be fastened to the end cap 18 before the cap 18 is inserted in the socket 28. The end of the central portion 10 forms a bottom at 44 for the portion 38 of the slot 36 in the event that the hairdresser desires to place the strap 16 in this portion of the slot 36.

The cap 20 includes a small slot 46 and socket 48 adapted to accept the enlarged knob 50 at the other end of the strap 16. The strap 16 is therefore stretched over the hair curl 14 and snapped into the socket 50 to retain the hair curl in place on the rod.

Figure 5:
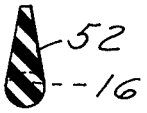
FIG. 5 is a cross-section of the strap tab taken along the line 5—5 of FIG. 2.

Formed integral with the strap 16 is a tab 52 extending therefrom as shown in FIGS. 1, 2 and 5. The tab 52 permits the hairdresser to conveniently lift the strap from the hair curl without disturbing the curl to adjust the position of the strap or move the strap to another radial position in the end cap 18.

I claim:

1. A permanent wave rod comprising a generally oblong rod and a strap extending from one end of the rod, the strap being adapted for attachment to the other end of the rod, a central portion of the rod comprising a central core of substantially rigid plastic and a separate soft pliable non-absorbent sleeve surrounding said central portion, said sleeve including a plurality of longitudinal grooves formed in the sleeve.

2. The permanent wave rod of claim 1 wherein the central portion sleeve is a soft pliable non-absorbent rubber.

3. The permanent wave rod of claim 1 including at least one end cap attached to the central portion, said end cap including means to attach the strap.

4. The permanent wave rod of claim 1 including a first grasping means on the strap for attachment to the other end of the rod, and a second grasping means extending from the strap substantially near the center of the strap between the ends of the rod.

5. The permanent wave rod of claim 1 wherein the central portion of the rod is generally concave and symmetrical about a perpendicular plane through the center of the rod.

6. A permanent wave rod comprising a generally oblong concave central portion and a strap extending from one end of the rod, said strap including means at the other end of the strap to grasp and to attach to the other end of the rod thereby to retain a hair tress in place about the rod, the improvement characterized by the central portion comprising a substantially rigid core with a soft pliable non-absorbent surface and a second grasping means extending from the strap at a location substantially midway between the ends of the rod.

7. The permanent wave rod of claim 6 wherein the central portion includes a rigid plastic core and the soft pliable non-absorbent surface comprises a rubber sleeve having a plurality of longitudinal grooves formed in the surface.

* * * * *